United States Patent [19]

Miller et al.

[11] Patent Number: 4,828,686

[45] Date of Patent: May 9, 1989

[54] CHEMICAL CONDITIONING OF FINE COAL FOR IMPROVED FLOTATION AND PYRITE REJECTION

[75] Inventors: Jan D. Miller; Yi Ye, both of Salt Lake City, Utah

[73] Assignee: University of Utah, Salt Lake City, Utah

[21] Appl. No.: 58,909

[22] Filed: Jun. 5, 1987

[51] Int. Cl.[4] ..... B03D 1/02

[52] U.S. Cl. ..... 209/166; 252/61; 44/625; 44/627; 241/20

[58] Field of Search ..... 209/166, 167; 44/15 R, 44/625, 627; 252/61; 241/20

[56] References Cited

U.S. PATENT DOCUMENTS

| | | | |
|---|---|---|---|
| 2,535,344 | 12/1950 | Bishop | 209/166 |
| 2,535,345 | 12/1950 | Bishop | 209/166 |
| 2,545,132 | 3/1951 | Bishop | 209/166 |
| 2,633,240 | 3/1953 | Bishop | 209/166 |
| 2,826,301 | 3/1958 | Le Buron | 209/166 |
| 4,199,065 | 4/1980 | Wang | 209/166 |
| 4,452,714 | 6/1984 | McCarthy | 209/166 |
| 4,474,619 | 10/1984 | Meyer et al. | 209/166 |
| 4,537,599 | 8/1985 | Greenwald | 209/173 |
| 4,543,104 | 9/1985 | Brown | 44/1 SR |
| 4,564,369 | 1/1986 | Burgess et al. | 209/166 |

FOREIGN PATENT DOCUMENTS

| | | | |
|---|---|---|---|
| 539608 | 2/1977 | U.S.S.R. | 209/166 |
| 863805 | 3/1961 | United Kingdom | 209/166 |

OTHER PUBLICATIONS

Advanced Inorganic Chemistry, a Comprehensive Text, by Cotton & Wilkinson, Subsection entitled "Peroxides, Peroxy Compounds, and Superoxides", p. 283.

"Effects of Oxidation of Coals on their Flotation Properties", pp. 396–401, Apr. 1954, Sun.

Fuel, vol. 53, "Studies on the Structure of Coals, Some Inferences About Skeletal Structures", pp. 240–245, 10–74, Chakrabartty.

"Oxidation Phenomena in Coal Flotation", Coal Preparation, vol. 4 by Fuerstenau et al., pp. 161–182, 1987.

"Flotation of Difficult-to-Float Coals", 10th International Coal Preparation Congress by Jilaskowski.

"The Characteristics of Oxidized Coal"-Coal-Preceedings 64th CIC Coal Symposium by Andersen, pp. 117–124, 1982.

"Coal Flotation", A. M. Gardin Men. Volumn. by Frank Aplan, pp. 1235–1264, 1976.

"Estimating the Floatability of Western Coal" by Aplan, pp. 380–398 (Gold, Uranium, Silver, Coal:-Geology Mining Extraction and the Environment.

Kirk Othmer Encyclopedia of Chemical Technology, 3rd Edition, pp. 1–23, "Peroxides and Peroxy Compounds", vol. 17.

*Primary Examiner*—Kenneth M. Schor
*Assistant Examiner*—Thomas M. Lithgow
*Attorney, Agent, or Firm*—Thorpe, North & Western

[57] ABSTRACT

A method for enhancing hydrophobicity of high volatile bituminous coal and coals of a lower grade and for separating ash and sulfur (including pyritic sulfur) contaminants from coal in a floatation process. The method comprises the steps of grinding the coal to small particulate size, forming a slurry of the ground coal and mixing the slurry with at least one compound selected from the group comprising inorganic peroxy compounds, the preferred compound being oxone which is a mixture of potassium monopersulfate, potassium hydrogen sulfate and potassium sulfate. This slurry is allowed to react to condition the particulate coal and develop increased hydrophobicity for the coal while depressing the sulfur contaminants and ash during froth flotation.

16 Claims, 3 Drawing Sheets

CHEMICAL CONDITIONING OF FINE COAL FOR IMPROVED FLOTATION AND PYRITE REJECTION

BACKGROUND OF THE INVENTION

1. Field of Invention

The present invention relates to methods for cleaning fine coal by means of froth flotation. More specifically, the present invention relates to chemical conditioning steps for enhancing the flotability of fine coal while at the same time depressing pyrite and other contaminants by flotation.

2. Prior Art

The future effective utilization of coal as an energy source will depend largely on the development of effective techniques for separation of ash and sulfur in an economical process. Otherwise, restrictions against $SO_2$ emissions will result in high cost for energy production, and will dictate in favor of other fuels rather than coal. The United States Department of Energy projects that by 1990 at least 54% of the electricity produced in the United States will be generated from coal. It is generally acknowledged, however, that this can only occur if processes are developed which enable the effective cleaning and production of compliance coal while at the same time providing for rejection of ash and sulfur.

With increased emphasis on maximum coal production, industry is now looking for total utilization of the coal, including coal fines and small particulate coal which has previously been discarded. Further, the production of a high quality, clean coal product may require grinding to fine particle size to achieve complete liberation. Coal flotation is one process which has been applied to cleaning coal fines for commercial use. Whereas in 1950, only a few flotation plants existed in the United States, 66 plants had developed flotation production by 1970. Currently, virtually all new preparation plants incorporate flotation into their plant design. In terms of production, coal flotation plant capacity in the United States has grown from 64,000 tons per day in 1975 to 145,000 tons per day in 1985. Despite the increased commercial interest, however, the separation of ash and sulfur from coals still remains a major challenge to developing cost effectiveness in the froth flotation method.

Froth flotation is a physicochemical separation process that depends on the attachment of hydrophobic particles to air bubbles. Other hydrophilic particles are wetted by the aqueous phase and will not attach to air bubbles. Thus, the separation of coal particles from gangue minerals occurs as air bubbles are dispersed through a suspension of coal particles (typically minus 28 mesh). The bubble/particle aggregates float to the surface and are collected as clean coal concentrate.

An unfortunate physical property of sulfur, and in particular pyrite, is its tendency to respond in the flotation process in the same manner as does the coal. In other words, those techniques which lead to enhanced flotability of coal also lead to enhanced flotability of pyrite. Conversely, those processes applied to depress the flotation of pyrite frequently lead to coal depression.

For example, the flotation process usually involves the use of suitable reagents, such as neutral molecular oils, to enhance the hydrophobic character of coal particles, while the gangue mineral particles remain hydrophilic. These neutral oils such as kerosene or fuel oil are called promoters and are used to enhance the attachment of air bubbles at the coal surface. This is done by forming a thin coating of promoter over the air bubble and/or particle to be floated. In addition, frothing agents such as methylisobutyl carbinol, terpinol, creosols, polyglycols, and some specially blended reagents are used. The choice of these reagents and level of addition depends on the coal to be floated and the desired level of selectivity with respect to ash and sulfur. Because pyrite from coal has some tendency to float, use of these agents tends to cause their flotation along with coal, destroying the clean coal product quality.

Where fine coal is subjected to the flotation process, greater amounts of promoter and frother agent are adsorbed due to high surface area. In fact, the liberated fine mineral matter itself attaches to the hydrophobic coal particles, resulting in a slime coating with an attendant pseudo-depression phenomenon. As a result of these complications, the production of super clean or even compliance coal by conventional froth flotation has been a most difficult task. Although some success has been achieved utilizing sodium hypochlorite for removal of sulphatic and organic sulfur, such oxidation practice has been generally unsuccessful in the removal of pyritic sulfur. These problems are most significant for coals such as medium volatile bituminous, high volatile bituminous and sub-bituminous coals.

It has been well known for many years that natural occurring coal tends to be hydrophobic. In fact, higher grade coals are extremly hydrophobic and need very little treatment to improve their amenabilitiy to flotation. With respect to the medium and lower grade coals, the natural hydrophobic character is decreased, particularly for the high volatile bituminous and sub-bituminous categories. Furthermore, the greater the ash content in the coal, the less hydrophobic is the material.

It is also generally known from the literature that surface oxidation of coal in most cases further decreases its hydrophobic character and leads to a poorer flotation response. (S. C. Sun, *Trans AIME,* vol. 6, No. 4, p. 396, 1954; S. K. Chakrabartty and N. Berkowitz, *Fuel,* vol. 53, p. 240, 1974; F. F. Aplan, *Flotation,* M. C. Fuerstenau editor, AIME, New York, p. 1235, 1976; R. R. Yarzab, Z. Abdel-Baset, and P. H. Given, *Geochimica et Cosmochimica Acta,* vol. 43, p. 281, 1979; D. W. Fuerstenau, J. M. Rosenbaum, and J. S. Laskowski, *Collids and Surfaces,* vol. 8, p. 153, 1983; D. W. Fuerstenau, G. C. C. Yang, and J. S. Laskowski, *Coal Preparation,* vol. 2, p. 1, 1986). This generally acknowledged fact is further evidenced by U.S. Pat. No. 4,452,714 by McCarthy. In fact, the McCarthy patent teaches the use of reducing agents to eliminate oxidized surfaces of the carbon for improvement of flotation. Similarly, U.S. Pat. No. 4,537,599 by Greenwald, Sr. teaches that "the oxidized surfaces of the coal particles are so altered that separation of tailings from the coal particles cannot be carried out by conventional means such as froth-flotation," column 2, lines 43–47. The oxidizing agent used in the Greenwald discussion was ozone. The Greenwald patent further discloses the teachings of U.S. Pat. No. 4,328,002 which discusses a process for treating coal to remove sulfur and ash which involves the steps of preconditioning coal particles in the presence of an oxidizing agent. The Greenwald patent indicates that such oxidants as $H_2O_2$, $HNO_3$, $HCLO_4$, HF, $O_2$, air and mild $NH_3$ or $CO_2$ are substantially ineffective to provide useful results in flotation processes. The reference further points out the problem that froth flotation cannot be used to separate ultra fine impurities that are freed by the action of the oxidants with respect to the carbon particles. It concludes that the known process of using an oxidant in coal flotation does not provide for separation of these impurities from coal particles less than 105 microns in size.

Accordingly, what is needed is an effective process for enabling the separation of pyritic sulfur and other contaminants from fine coal as part of an economical froth flotation process.

OBJECTS AND SUMMARY OF THE INVENTION

It is therefore an object of the present invention to provide an improved conditioning procedure for enhancing the hydrophobic character of the coal while at the same time depressing ash minerals which contaminate the coal.

Yet another object of the present invention is to provide depression of pyrite and other sulfur contaminants in grade coals.

A further object of the present invention is to provide a method useful with high volatile bituminous and sub-bituminous coals for enhancing their hydrophobic character in a flotation process.

Another object of the present invention is to provide a conditioning step for enhancing operation of conventional flotation processes with respect to low grade coals having high mineral matter content including ash and pyritic sulfur in particular.

These and other objects are realized by applying a conditioning step of controlled oxidation utilizing particular oxidizing agents exemplified by three groups: to wit—peroxy compounds, peroxides and superoxides. The preferred group is the peroxy family represented by potassium monopersulfate (potassium peroxymonosulfate), with potassium hydrogen sulfate and potassium sulfate in mixture. These mixtures are commercially available and are marketed under the tradenames Oxone and Interox KMPS for example. Typically these are applied in a high solids concentration immediately before the conventional flotation separation process. Conditioning of the coal prior to flotation is effective in increasing the hydrophobic character of the coal while at the same time reducing ash and sulfur contamination of the resultant cleaned coal. Specifically, ash and pyritic sulfur rejection is greatly improved by the same oxidation compounds which enhance the hydrophobic character of the coal.

Other objects and features of the present invention will be apparent to those skilled in the art in view of the following detailed description, taken in combination with the accompanying drawings.

DETAILED DESCRIPTION OF THE INVENTION

Figure 1:
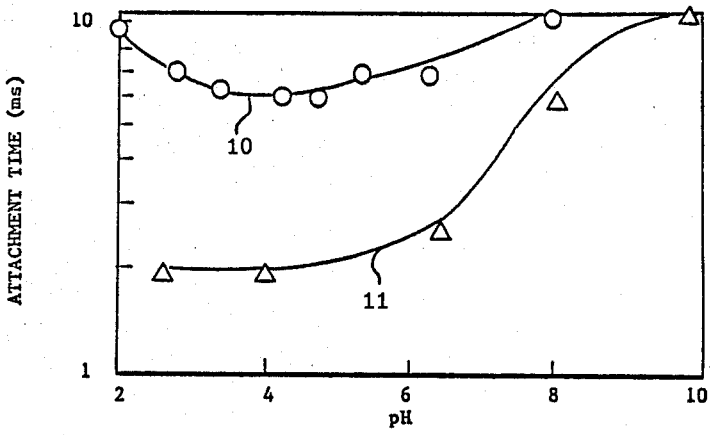
FIG. 1 represents a graphic comparison of bubble attachment time for high volatile bituminous coal particles as a function of pH with and without conditioning in accordance with the present invention.

Despite a long history of acknowledged adverse consequences of oxidation of fine coal material to be processed in flotation, the present inventors have discovered that certain classes of oxidants surprisingly result in the opposite effects of increased hydrophobicity for coal fines, yet improved depression of ash and sulfur contaminants.

Prior art literature explains that coal can be oxidized by a variety of oxidants such as $HNO_3$, $K_2Cr_2O_7$/-$HNO_3$, $KMNO_4/OH^-$, BuOOH/AIBN, $H_2O_2$, trifluoroacetic acid, and peracetic acid or by ambient air or pure oxygen. The rate of oxidation has been shown to be a function of particle size, rank, temperature, time, concentration of oxidants, and petrographic composition of coal. With these oxidants the coal has been reported generally and consistently to become hydrophilic as oxidation occurs.

When the oxidation is extended, the polymeric and amorphous humic acids are produced. The functional groups present in humic acids are hydroxyl, carboxyl, phenolic, alcoholic, carbonyl, and methoxyl groups. Also, it is usually known that the lower the coal rank, the greater its susceptibility to attack by oxygen or other oxidants. Therefore, prior art techniques have intentionally avoided oxidation as a major step in flotation in almost all phases of the fine-coal-cleaning research and in commercial application of flotation technology.

Quite to the contrary of these studies and conclusions, the present invention shows that hydrophobicity and flotability of high-volatile bituminous or other low-rank coals can be greatly improved by specific oxidants. The present inventors have discovered that particular families of compounds are effective as preconditioners in improving hydrophobic character. These primarily include the inorganic peroxy compounds. The preferred family is the peroxy group represented by potassium monopersulfate and Caro's acid (peroxymonosulfuric acid). Additional members of this family include peroxydisulfate and peroxy carboxylite. This group is characterized by the presence of a —O—O— bond (See Advanced Inorganic Chemistry, Cotton & Wilkinson, Interscience Publishers, 1962).

The peroxide family is somewhat less effective but is operable as a conditioner in higher concentrations. For example, Sodium persulfate and sodium peroxide have demonstrated the desired conditioning effect. Other peroxides include pyrosulfate and the organic peroxides such as benzyol peroxide. Because of similar chemical properties, it is believed that the superoxide family would also enhance hydrophobic properties for coal subjected to treatment. This latter family is characterized by the presence of $O_2^-$ions. Examples of this latter family include $KO_2$, $Ba[O_2]$, $R6O_2$ and $CsO_2$. The critical criteria in application of these compounds are their oxidation potentials, reaction mechanisms at the coal surface, the amount of reagent, storage temperature of the compounds, cost and production and catalysis of compound degradation by metallic impurities. Specific identification and balancing of these parameters will be apparent to those skilled in the art, based upon the following examples and detailed description.

The preferred embodiment set forth in this disclosure utilizes a salt of peroxymonosulfate in the conditioning treatment of the coal particles. This salt is available from a number of suppliers. For example, in these experiments Oxone was used. Oxone is a white, granular free-flowing triple salt powder with the formula $2KHNSO_5 \cdot KNSO_4 \cdot K_2SO_4$, sold by E.I. du Pont de Nemours & Company. The major active component of Oxone is potassium monopersulfate (or potassium peroxymonosulfate). The following table sets forth the physical properties of Oxone.

TABLE 1

| Physical Properties and Typical Analysis of Oxone | |
|---|---|
| Chemical formula | $2KHSO_5.KHSO_4.K_2SO_4$ |
| Molecular weight | 614.7 |
| Active oxygen, | |
| % min. | 4.5 |
| % average analysis | 4.7 |
| % theoretical (triple salt) | 5.2 |
| Active component ($KHSO_5$) % min. | 42.8 |
| Bulk density, | |
| $g/cm^3$ ($mg/m^3$) | 1.12–1.20 |
| $lb/ft^3$ | 70–75 |
| Particle size through USS #20 | |
| sieve, % | 100 |
| #200 sieve, % max. | 10 |
| pH @ 25 deg. C. (77 deg. F.), | |
| 1% solution | 2.3 |
| 3% solution | 2.0 |
| Solubility g/100 g $H_2O$, 20 deg. C. (68 deg. F.) | 25.6 |
| Moisture content, % | 0.1 |
| Stability, % active oxygen loss/mo | 1 |
| Standard electrode potential (E deg) volts | −1.44 |
| Heat of decomposition, | |
| kJ/kg | 251 |
| Btu/lb | 108 |
| Thermal conductivity, W/m.K | 0.151 |
| $Btu.ft/h.ft^2$ | 0.093 |

Coal materials utilized in the following examples include medium-volatile bituminous, high-volatile bituminous and sub-bituminous coals. The source and characteristics of these coals are set forth in Table 2.

TABLE 2

| Coal Samples Evaluated | | Character | | |
|---|---|---|---|---|
| Coal/Rank | Mine/Plant Location | % Ash | % Total S | % Pyritic S |
| Medium-Volatile Bituminous | Helvetia/Helen Homer City, PA | 7.0 | 1.10 | 0.60 |
| High-Volatile Bituminous | Valley Camp Helper, Utah | 6.9 | 0.70 | — |
| Sub-Bituminous | Clovis Point Mine Gillette, WY | 11.0 | — | — |
| Pittsburgh Coal Consolidation | Ireland Mine Coal Co. | 26.3 | — | 1.24 |

FIGS. 1 through 10 represent measurements taken from different conditioning reactions and measurements of hydrophobicity, flotability, and/or ash/sulfur rejection.

Measurement of particle/bubble attachment time was carried out with high volatile bituminous coal particles. The attachment time was measured with an Electronic Induction Timer, product of Virginia Coal and Mineral Services, Inc. In the measurement, a captive bubble approximately 2 millimeters in diameter held on a bubble tube was pushed downward through the aqueous solution by an electromechanical power driver. The bubble was kept in contact with a bed of coal particles for a given time as established by the pulse frequency generated by a microcomputer. After the bubble, together with the tube, returned to its original position it was visually observed through a microscope to determine whether attachment of coal particles at the bubble surface had occurred.

The experiment was repeated to obtain ten observations by changing the position of the particle bed and the number of observations which resulted in attachment was recorded. The contact time controlled by the built-in microcomputer was then changed by adjusting the pulse frequency and further measurements at the new contact time were made.

Finally the contact time at which 50% of the observations resulted in attachment was taken as the attachment time, as known in the art. HCl and NaOH were used as pH adjusting reagents in the measurement.

One group of measurements was made to determine the natural particle/bubble attachment time of the high-volatile bituminous coal particles. In another group of measurements, the coal particles were first placed into solution with $8 \times 10^{-4}$ M Oxone at a given solids concentration for 10 minutes. The coal particles were then filtered and completely washed with distilled water and were replaced into distilled water again to measure the attachment time. Thus, the effect of the Oxone reaction at the coal surface on the attachment time was evaluated and the relative change in hydrophobicity determined by comparing results from these two groups of experiments. FIG. 1 displays the relationship of attachment time of high-volatile bituminous coal particles on air bubbles as a function of pH. Particle size was approximately $100 \times 200$ mesh. Line 10 represents the attachment time for natural, untreated coal particles. Line 11 shows the significantly improved results for coal which is conditioned in 0.0008 M Oxone solution for 10 minutes in a solution of 0.5% solids. The attachment time is reduced by a factor of three to about 2 milliseconds.

Size reduction of as-received coal samples for flotation was carried out with a steel ball mill at 40% solids. After grinding for a given time, the slurry was divided into three parts. One part was used for size analysis and the other two parts were used for flotation with and without Oxone conditioning respectively. The slurry which was to be conditioned was placed into a glass container with addition of Oxone at given dosages and then mixed in an orbit shaker for 30 minutes. HCl or NaOH was also added during conditioning for pH adjustment. After conditioning, the slurry was transferred to the flotation machine.

Flotation experiments were accomplished with a 2-liter Galigher flotation machine at 15% solids, 4 liters per minute air flow rate and 900 rpm. As known in the art, commercial grade methyl isobutyl carbinol and kerosene were applied as frother and promoter respectively. Dosages of these two reagents used in the study vary with the coal rank and are presented in conjunction with the experimental results in the drawings.

After flotation, the concentrate and tailings were filtered, dried and analyzed. In the case of two-stage flotation, the concentrate from the first stage flotation was transferred to another flotation cell and repulped by adding fresh water. Only MIBC was added in the second stage flotation. Yield was calculated with the concentrate from the second stage flotation machine and the feed to the first stage of flotation. Except for the measurement of bubble/particle attachment time, tap water was used for all the experiments. These experiments were run at ambient temperature.

Figure 2:
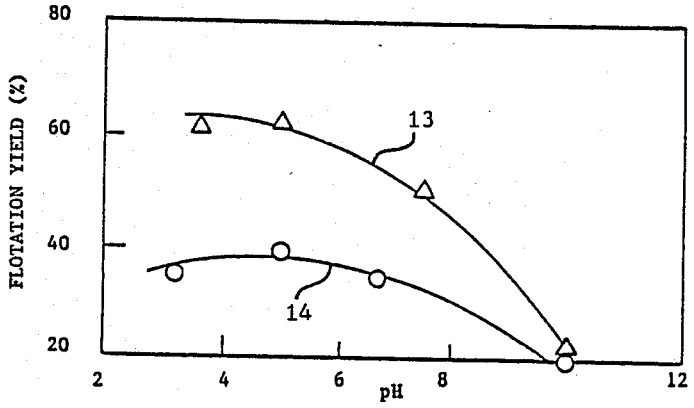
FIG. 2 represents a graphic comparison of single-stage flotation yield of high-volatile bituminous coal with and without conditioning in accordance with the present invention as a function of flotation pH.
Figure 3:
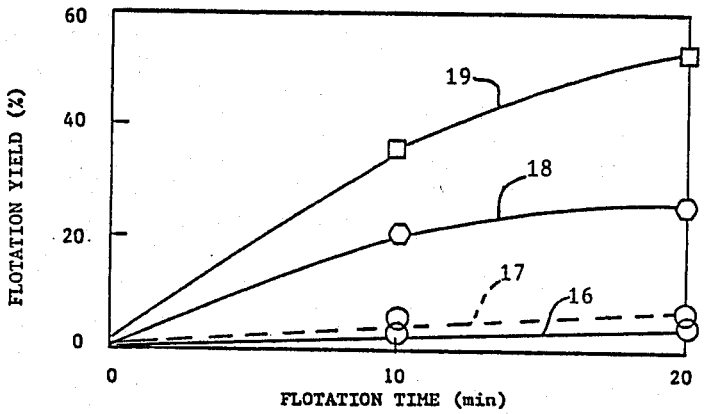
FIG. 3 graphically illustrates the single-stage flotation yield of sub-bituminous coal with and without conditioning in accordance with the present invention.
Figure 4:
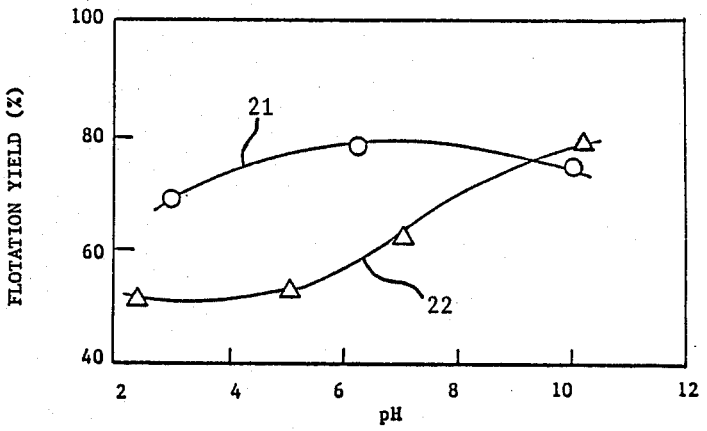
FIG. 4 gives single stage flotation yield of medium-volatile bituminous coal as a function of pH with and without conditioning from the present invention.

As can be seen from FIGS. 2, 3 and 4, the effect of potassium monopersulfate (or potassium peroxymonosulfate) on the flotability of coals of different rank is significant. FIG. 2 illustrates the improved yield resulting from the present invention as a function of pH for the high-volatile bituminous coal. This figure relates to a single-stage flotation process wherein particle size was approximately 400 mesh. Flotation additives included MIBC at 0.2 kg per ton and kerosene at 1.5 kg per ton. Conditioning was accomplished with Oxone at 15 kg per ton for 30 minutes. The pH of the conditioning step and flotation were the same, with the flotation time being 15 minutes. Line 14 represents the coal conditioned without Oxone, while line 13 shows the improved yield from Oxone treatment. It is evident that the greatest effect is achieved in acidic solution.

FIG. 3 compares per cent yield versus flotation time for sub-bituminous coal. This figure relates to a single-stage flotation process wherein coal particle size was approximately 85% passing through 400 mesh. Flotation additives included MIBC at 0.5 kg per ton and kerosene at 7 kg per ton (lines 16, 18 and 19) and 20 kg per ton (line 17). Conditioning was accomplished with Oxone at 20 and 100 kg per ton respectively. The pH of the conditioning step and flotation were controlled at approximately pH 4. Lines 16 and 17 represent the coal conditioned without Oxone addition using kerosene additive in flotation at 7 kg and 20 kg per ton respectively. Line 18 shows the improved effect of Oxone conditioning at 20 kg per ton. Line 19 demonstrates greater improvement when the amount of Oxone is increased to 100 kg per ton.

In contrast, FIG. 4 illustrates some depression for medium-volatile coal subjected to Oxone treatment. The figure represents a single-stage flotation process with 400 mesh particle sizes measuring yield as a function of pH. No promoter was used, but 0.05 kg per ton of MIBC was added in the flotation. Flotation time was 10 minutes. Line 21 shows the nontreated coal and line 22 depicts the reduced yield of medium-volatile coal after conditioning with Oxone at 6 K2/ton.

After Oxone conditioning, the flotability of high volatile bituminous coal and sub-bituminous coal is improved significantly. The medium volatile bituminous coal with a naturally strong flotability was slightly decreased, although the dosage of Oxone applied in the conditioning for the latter was less than that for the former. It is apparent that such effects are pH dependent. For example, activation of low rank coals by potassium monopersulate occurs in an acidic pH region.

Sub-bituminous coal used in the study is extremely difficult to float regardless of the dosage of the promoter. After kerosene dosage is increased to 20 kilograms per ton from seven kilograms per ton, the coal still remains unfloatable (compare line 16 with line 17 in FIG. 3). In contrast, FIG. 3 also illustrates how flotation recovery is improved as the Oxone dosage in conditioning increases. Improvement of the flotation recovery by reaction of potassium monopersulfate at the coal surface is far beyond that which can be provided by kerosene.

Figure 8:
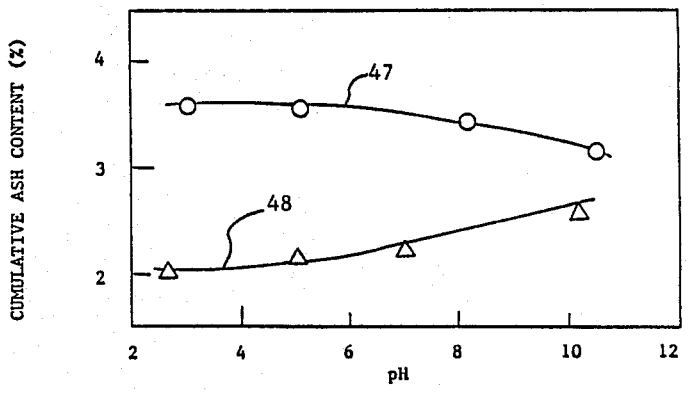
FIG. 8 gives ash content in medium-volatile bituminous coal concentration from single stage flotation as a function of pH with and without oxone conditioning.
Figure 9:
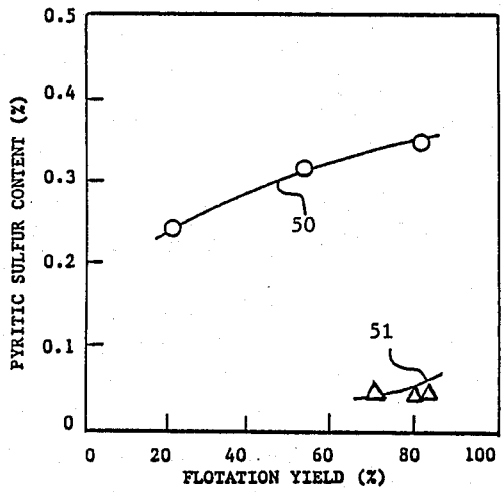
FIG. 9 is a plot of pyritic sulfur content in medium-volatile bituminous coal concentrate from single stage flotation versus yield with and without oxone conditioning.

Although the medium volatile bituminous coal is slightly depressed by Oxone conditioning, the floatability of this coal can easily be restored by adding a little kerosene during flotation. Further, the reduction in ash and sulfur for this coal by treatment with oxone is significant as shown in FIGS. 8 and 9 which will be discussed hereafter.

Figure 5:
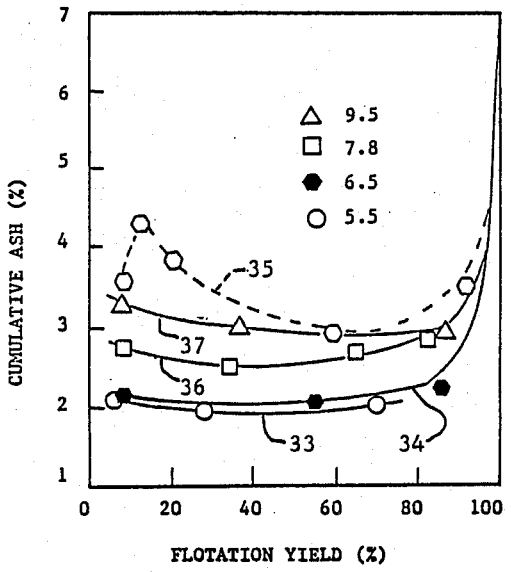
FIG. 5 is a graphic plot of cumulative ash content in high-volatile bituminous coal concentrate versus flotation yield from single-stage flotation with and without the conditioning step at different pH values subject to the present invention.

A major advantage of potassium monopersulfate for fine coal flotation is the improved ash rejection which develops during the flotation. This is apparent from FIGS. 5, 6, 7 and 8. FIG. 5 illustrates a single-stage flotation process where ash content is measured with respect to yield for high-volatile bituminous coal at different pH values. Coal particle size was approximately 400 mesh. MIBC at 0.2 kg per ton and kerosene at 1.5 kg per ton were used in the flotation. Oxone conditioning was at 6.5 kg per ton. Line 33 represents processing at a pH of 5.5 with Oxone conditioning. Line 34 represents processing at a pH of 6.5 with Oxone conditioning, while the broken line 35 is the same without Oxone conditioning. Lines 36 and 37 depict processes at pH values of 7.8 and 9.5 respectively.

Figure 6:
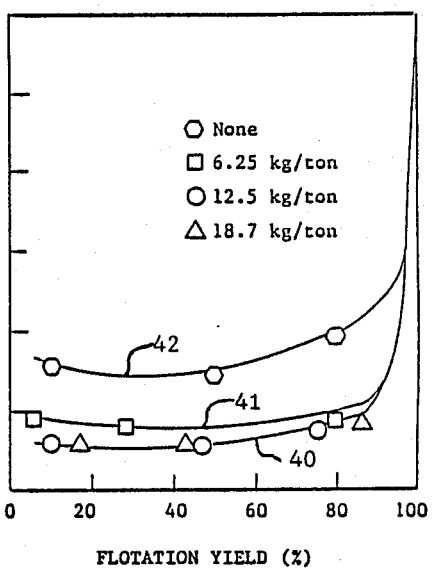
FIG. 6 is a graphic plot for cumulative ash content of the high-volatile bituminous coal concentrate versus flotation yield from a two stage flotation process with and without the conditioning step of the present invention and at a pH of 5.0.

FIG. 6 illustrates cumulative ash versus yield for a single-stage rougher and single-stage cleaner process. Coal utilized in this process was the high-volatile bituminous coal and 400 mesh particle size. 1.5 kg per ton of kerosene and 0.2 kg per ton of MIBC were used in the flotation stage at a pH of 5.0. Line 40 represents lowest ash accumulation with Oxone dosage levels at 18.75 and 12.50 kg per ton. Line 41 shows less improved ash rejection at 6.25 kg per ton of Oxone. Line 42 depicts poorest ash rejection where no Oxone conditioning step was applied.

Figure 7:
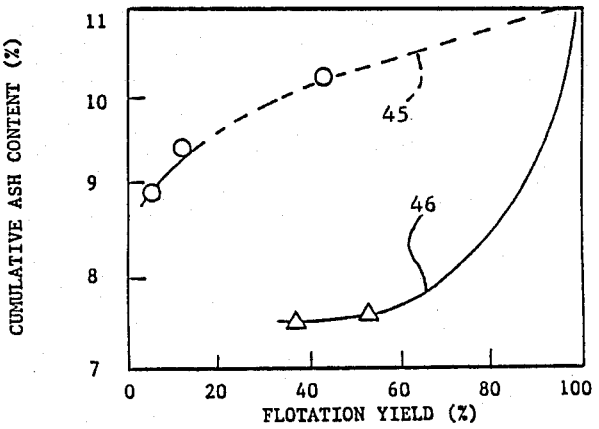
FIG. 7 is a graphic plot similar to FIG. 5 but utilizing sub-bituminous coal as the coal material and at a pH of 3–4.

FIG. 7 compares the ash content for sub-bituminous coal in a one-step flotation process. pH for both conditioning and flotation was held to 3–4. MIBC and Kerosene were used in the flotation stage at 0.5 and 7 kg per ton respectively. Line 45 shows the high contamination by ash without Oxone conditioning in accordance with the present invention. Line 46 illustrates the dramatic improvement with 100 kg per ton of Oxone to condition the coal prior to flotation.

Finally FIG. 8 shows the ash content of the clean coal product for single stage flotation of medium-volatile bituminous coal as a function of pH with and without Oxone treatment at particle size of about 400 mesh, 0.05 kg/ton MIBC, and 0.5 kg/ton kerosene. Flotation time is 15 minutes and the yield is controlled at 75–80%. Again a significant reduction in ash is evident by comparison of line 47 with line 48, representing nontreated and oxone treated coals respectively.

It can be readily seen that the ash contents of all clean coal products from the Oxone conditioning process are much less than that from conventional flotation. The effect of Oxone on ash rejection is also pH dependent. As can be seen from FIGS. 5 and 8, the ash content in the clean coal products falls with decreasing pH.

The scope of the improvement in ash rejection by utilizing potassium monopersultate in comparison with conventional flotation is related to the coal rank and the dosage of the Oxone. The ash rejection for high volatile bituminous coal is improved as the dosage of Oxone in the conditioning step increases, but becomes stable when such a dosage is beyond 12.5 kilograms per ton (FIG. 6) under circumstances described above. For medium volatile bituminous coal, significant improvement in ash rejection is obtained even when Oxone utilized in the conditioning process is at three kilograms per ton.

Figure 10:
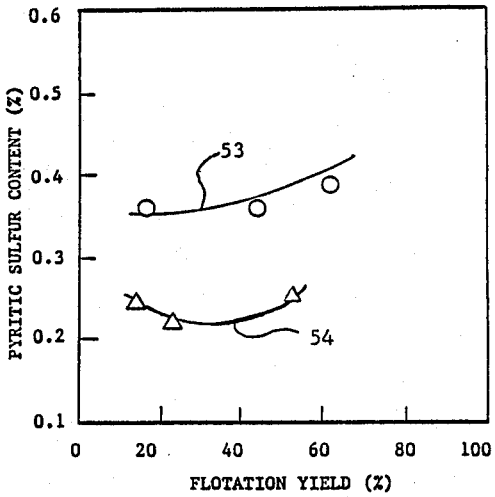
FIG. 10 is a graphic plot similar in structure to FIG. 9 but utilizing Pittsburgh coal as the coal material.

Still another benefit of applying potassium monopersulfate in fine coal flotation is pyritic sulfur reduction in the clean coal product as illustrated in FIGS. 9 and 10. FIG. 9 graphically depicts the effect of conditioning on pyritic sulfur rejection from the medium-volatile bituminous coal in a single-stage flotation process. Particle size of the coal was 400 mesh, with 0.05 kg per ton of MIBC and 0.5 kg per ton of kerosene being used at pH of 5.5. Improvement in sulfur rejection is shown by line 51 for coal conditioned at 3.3 kg per ton, as compared to absence of treatment shown in line 50. FIG. 10 gives the same trend of improved pyritic sulfur rejection for Pittsburgh coal when the peroxy compound is used for conditioning. Line 53 represents the untreated coal and Line 54 depicts reduced pyritic sulfur content when the coal is conditioned with Oxone at 117 kg/ton.

The effects of potassium monopersulate on coal flotability, ash rejection and sulfur rejection may be due to unique oxidation reactions at the coal and pyrite surfaces. The standard electrode potential of monopersulfate is −1.44 volts for the reaction:

$$HSO_4 + H_2O — HSO_5 + 2H^+ + 2e^-$$

Due to this high potential, many hydrocarbon, hydroxyl, carbonyl, and sulfur compounds can react with Oxone and be transformed to other compounds.

As was previously mentioned, these results were unexpected and lead to the conclusion that such unique oxidation reactions increase the hydrophobicity and flotability of high- volatile bituminous and other low rank coals.

Although the actual mechanism for the reactions occurring has not been established, it is clear from FIG. 1 that the change in flotability for high-volatile bituminous coal caused by Oxone conditioning is because the coal particles become more hydrophobic after treatment. This is confirmed by the fact that the bubble attachment time of Oxone-conditioned high volatile bituminous coal particles is significantly less than that of untreated particles.

Bubble attachment time is defined as the time required for the disjoining water film between the solid phase and gas phase to reach a thickness such that rupture of the water film and true attachment of the solid phase with the gas phase takes place. The shorter the bubble attachment time, the higher the hydrophobicity of the coal.

Such an increase in the hydrophobic characteristics will facilitate the separation of coal particles from mineral matter during flotation. However, improvement of ash rejection by Oxone conditioning in flotation, in comparison with conventional flotation is not solely due to this effect. Ash removal by the Oxone conditioning process for medium-volatile bituminous coal is also improved, although its flotability is reduced after Oxone conditioning, as can be seen from FIG. 4.

Figure 11:
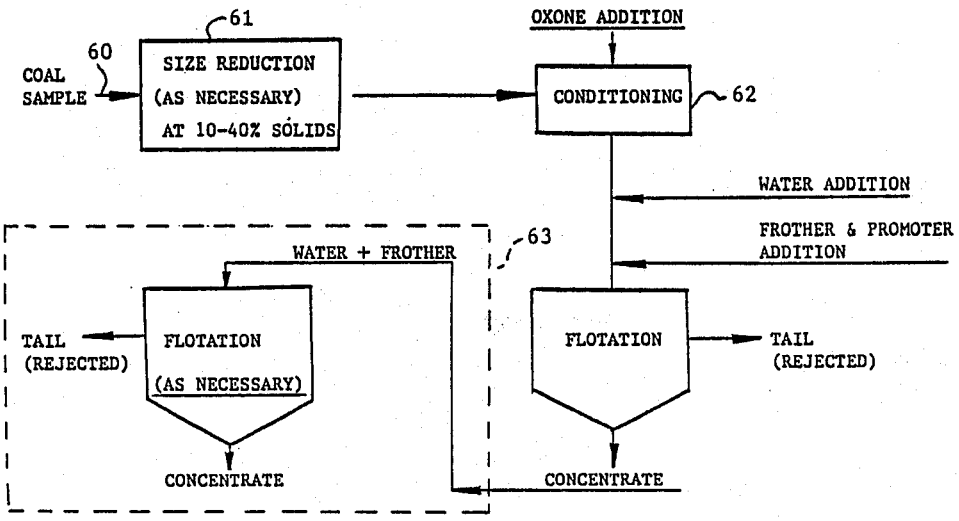
FIG. 11 graphically illustrates the present process in terms of a flow chart for flotation.

The basic process of the present invention is represented in block diagram form in FIG. 11. Coal 60 is introduced for processing with initial size reduction 61. Typically, this size will be within the range of less than 100 mesh. Grinding if necessary is generally done in a suspension of coal in water at 10% to 40% solids. 50% has been effective in experimentation to date. The coal is then subjected to the conditioning step 62 involving the appropriate reagents as previously set forth. The remaining steps of the treatment involve conventional flotation. The block diagram illustrates a two stage procedure, with the second stage 63 shown in the broken lines.

With regard to super clean or compliance coal production for power generation, the present invention has multiple advantages over any other process available at the present time. First, mature and conventional froth flotation with a high productive capacity can be readily adopted with slight modification in process. The requirement for development of a large scale production facility and high capital expenditure is thus virtually eliminated.

Secondly, the additional cost incurred by the process is mostly the cost of the chemicals, which is determined by the coal rank, the clean-coal product specifications and the type of compounds as previously discussed. At the present time, the cost is expected to be only several dollars per ton for medium or high-volatile bituminous coal of a high rank where Oxone is used. Further reduction in cost can be made by modification of the oxidants and as the process is further optimized.

Thirdly, these compounds are originally applied for other industrial and civil purposes such as swimming pools, cleaning and laundry bleach. These compounds have a low-order of toxicity. Accordingly, no special investment for equipment with regard to safety and environmental needs are contemplated. Finally, these compounds are compatible with many other compounds and chemicals. Such special requirements on clean coal product and further breakdown on cost can thus be achieved by reason of this compatibility.

We claim:

1. In a method for enhancing hydrophobicity of coal of high volatile bituminous rank or lower grade rank as part of a process of froth flotation and separation of coal, the improvement comprising treating the feed coal prior to completion of flotation with at least one compound selected from the group consisting of inorganic peroxy compounds in the absence of polymerization said at least one compound being present in an amount sufficient to enhance hydrophobicity of said feed coal to thereby enable said coal to be separated with the froth component in the flotation process.

2. A method as defined in claim 1, wherein the at least one compound comprises a potassium monopersulfate.

3. A method as defined in claim 1, wherein the at least one compound comprises a Caro's acid.

4. A method as defined in claim 1, further comprising the steps of:

treating the coal with the selected compound in a solution of water; and maintaining the water solution at a pH of less than 7.

5. A method as defined in claim 4, wherein the coal composition of the water solution is from approximately 10 to 50 percent sodids.

6. The method as defined in claim 1, the improvement comprising treating the coal with the selected compound prior to flotation.

7. The method as defined in claim 1, the improvement comprising treating the coal with the selected compound during flotation of the coal.

8. A method for enhancing hydrophobicity of coal of high volatile bituminous rank or lower grade rank and for separating ash and sulfur contaminants from said coal as part of a froth flotation and separation process, said method comprising, without limitation as to order, the steps of:

(a) grinding the feed coal to a particulate size of less the 100 mesh;

(b) forming a slurry of the ground coal with water;

(c) mixing the slurry of coal with at least one compound selected from the group consisting of inorganic peroxy compounds, said at least one compound being present in a sufficient amount to enhance hydrophobicity to resulting cleaned coal and to depress the sulfur and ash contaminants;

said steps being conducted in the absense of polymerization and being followed by the froth flotation of the coal, said cleaned coal being collected with froth from the flotation components and contaminants being reported to underflow.

9. A method as defined in claim 8, wherein the at least one compound comprises potassium monopersufate.

10. A method as defined in claim 8, wherein the method is practiced as part of a process for preconditioning and flotation of coal which is selected from the coal ranks comprising sub-bituminous coal.

11. A method as defined in claim 8, further comprising the step of maintaining the slurry at a pH of less than 7 during mixing of the selected compound therein.

12. A method as defined in claim 8, further comprising the step of maintaining the slurry at a pH of less than 5 during mixing of the selected compound therein.

13. A method as defined in claim 8, comprising the specific step of forming a slurry of ground coal selected from the group comprising sub-bituminous coal.

14. A method as defined in claim 8, comprising the specific step of forming a slurry of ground coal which includes substantial quantities of pyritic sulfur contaminant.

15. A method as defined in claim 8, comprising the more specific steps of:

forming a slurry of the ground coal of at least 30% solids; and mixing the slurry of coal with at least 1 kg/ton coal of the selected compound.

16. A method as defined in claim 8, further comprising the step of adding to the flotation slurry at least one additive selected from the group comprising neutral molecular promoter oils and frother.

* * * * *